US006784149B2

(12) United States Patent
Bauer et al.

(10) Patent No.: US 6,784,149 B2
(45) Date of Patent: Aug. 31, 2004

(54) LAUNDRY DETERGENTS AND CLEANERS COMPRISING MICRODISPERSE SILICATE-CONTAINING PARTICLES

(75) Inventors: Harald Bauer, Kerpen (DE); Günther Schimmel, Erftstadt (DE)

(73) Assignee: Clariant GmbH, Frankfurt (DE)

( * ) Notice: Subject to any disclaimer, the term of this patent is extended or adjusted under 35 U.S.C. 154(b) by 251 days.

(21) Appl. No.: 10/021,596

(22) Filed: Dec. 12, 2001

(65) Prior Publication Data

US 2002/0111287 A1 Aug. 15, 2002

(51) Int. Cl.[7] ..... C11D 3/08

(52) U.S. Cl. ..... 510/334; 510/220; 510/222; 510/232; 510/276; 510/329; 510/343; 510/400; 510/460; 510/486; 510/507; 510/511; 510/532

(58) Field of Search ..... 510/220, 222, 510/232, 276, 329, 343, 400, 460, 486, 507, 511, 532, 334

(56) References Cited

U.S. PATENT DOCUMENTS

| | | | | | |
|---|---|---|---|---|---|
| 3,884,826 | A | * | 5/1975 | Phares et al. | 510/112 |
| 4,062,647 | A | * | 12/1977 | Storm et al. | 8/137 |
| 4,105,574 | A | * | 8/1978 | Culmone et al. | 510/197 |
| 4,124,523 | A | * | 11/1978 | Johnson | 510/398 |
| 4,397,755 | A | * | 8/1983 | Brierley et al. | 510/397 |
| 4,511,487 | A | * | 4/1985 | Pruhs et al. | 510/221 |
| 4,591,448 | A | * | 5/1986 | Goedhart et al. | 510/220 |
| 4,595,520 | A | * | 6/1986 | Heile et al. | 510/380 |
| 4,597,886 | A | * | 7/1986 | Goedhart et al. | 510/226 |
| 4,842,758 | A | * | 6/1989 | Crutzen | 510/321 |
| 4,911,851 | A | * | 3/1990 | Ladd et al. | 510/297 |
| 5,002,762 | A | * | 3/1991 | Bolich, Jr. | 424/70.12 |
| 5,160,448 | A | * | 11/1992 | Corring | 510/370 |
| 5,213,706 | A | * | 5/1993 | Rapisarda et al. | 510/221 |
| 5,419,846 | A | * | 5/1995 | Jaekel et al. | 510/442 |
| 5,679,877 | A | * | 10/1997 | Erilli et al. | 510/218 |
| 5,709,815 | A | * | 1/1998 | Heffner et al. | 252/186.39 |
| 5,821,214 | A | * | 10/1998 | Weibel | 510/368 |
| 5,851,978 | A | * | 12/1998 | Shana'a | 510/417 |
| 6,194,372 | B1 | * | 2/2001 | Picken et al. | 510/403 |
| 6,287,346 | B1 | * | 9/2001 | Ofosu-Asante et al. | 8/103 |
| 6,539,954 | B1 | * | 4/2003 | Schimmel et al. | 134/25.3 |

FOREIGN PATENT DOCUMENTS

| | | |
|---|---|---|
| DE | 28 09 371 | 9/1978 |
| DE | 36 03 471 | 8/1987 |
| EP | 0 252 708 | 1/1988 |
| EP | 0 262 358 | 4/1988 |
| EP | 0 368 559 | 5/1990 |
| WO | 90/13533 | 11/1990 |
| WO | 99/00457 | 1/1999 |
| WO | 01/27236 | 4/2001 |
| WO | 01/32820 | 5/2001 |
| WO | 01/83662 | 11/2001 |
| WO | 01/96511 | 12/2001 |

OTHER PUBLICATIONS

English abstract for WO 90/13533, Nov. 15, 1990.
English abstract for WO 99/00457, Jan. 7, 1999.
EPO Search Report, for application No. 01128892, mail date Apr. 4, 2002.
English abstract for DE 3603471, Aug. 6, 1987.
English abstract for EP 0262358, Apr. 6, 1988.
English abstract for WO 01/27236, Apr. 19, 2001.
English abstract for WO 01/32820, May 10, 2001.

* cited by examiner

*Primary Examiner*—Charles Boyer
(74) *Attorney, Agent, or Firm*—Richard P. Silverman

(57) ABSTRACT

The invention relates to laundry detergents and cleaners comprising microdisperse, hydrophilic silicate-containing particles. The particle diameter of the particles is preferably 1 to 500 nm. The addition of the silicate-containing particles leads to improved soil release with a simultaneous reduction in the tendency for resoiling.

9 Claims, No Drawings

LAUNDRY DETERGENTS AND CLEANERS COMPRISING MICRODISPERSE SILICATE-CONTAINING PARTICLES

BACKGROUND OF THE INVENTION

The invention relates to laundry detergents and cleaners comprising silicate-containing, microdisperse hydrophilic particles and having good soil release properties and a low tendency for resoiling of the surfaces to be cleaned.

WO 99/00457 describes a facade coating which reduces the soiling tendency of facades.

In EP 252 708, it is found that the addition of colloidal silica to rinse aids reduces the drying time.

EP 368 559 describes the use of finely divided silica as an abrasive.

DE 2 809 371 describes the use of polydimethylsiloxane and colloidal silica which has an abrasive action.

The abovementioned specifications refer to the abrasive action of colloidal silica and its thickening effect in a formulation.

SUMMARY OF THE INVENTION

Surprisingly, it has now been found that the addition of microdisperse, hydrophilic silicate-containing particles to laundry detergents and cleaners facilitates soil release, increases the cleaning action and reduces the resoiling of the surfaces treated in this way.

The silicate-containing particles act as surface-coating agents which, upon application to the surfaces, displace the soiling and at the same time, as a result of the coating of the surfaces, hinder their resoiling. Repeated use of the laundry detergents and cleaners enhances the effect.

DETAILED DESCRIPTION OF THE INVENTION

An essential feature of the silicate-containing particles is their ability to form sufficiently small particles in aqueous dispersion and/or upon application to surfaces. Microdisperse refers to the particle size of the silicate-containing particles. Particles which do not form sufficiently small particles or which do not form particles at all in solution or upon application to surfaces are unsuitable for the invention.

The invention provides laundry detergents and cleaners comprising microdisperse, hydrophilic silicate-containing particles.

The invention likewise provides for the use of microdisperse, hydrophilic silicate-containing particles as surface-coating agents for enhancing soil release and reducing the tendency for resoiling in laundry detergents and cleaners.

The silicate-containing particles preferably have a particle size of from 1 to 500 nm, particularly preferably 9 to 50 nm.

In a preferred embodiment, the surface of the silicate-containing particles is ionically charged. As a result of the electrical charge, the soil is released more readily and resoiling is hindered. Preferably, the silicate-containing particles are negatively charged.

Particularly preferred silicate-containing particles are colloidal silica sols sold by Clariant GmbH as ®Klebosol and by Bayer as ®Baykisol. Furthermore, the synthetic clay minerals hectorite and saponite from Laporte (®Laponite grades), Südchemie (®Optigel) and Clariant GmbH (®SKS-20 and ®SKS-21) are also particularly suitable.

In a preferred embodiment, the silicate-containing particles are simultaneously used with hydrophobicizing agents, which enhances soil release and reduces the tendency for resoiling.

Preferred hydrophobicizing agents are silicones, silicone oils and/or fluorosilicone oils, e.g. the antifoam emulsions ®SE36 and ®SE39, the antifoam ®S850 and the antifoam powders ®ASP 8,®ASP 15, ®ASP16, ®ASP 20 and ®ASP30 from Wacker.

Polyorganosiloxanes, such as, for example, polydimethylsiloxanes, polysiloxanes, alkyl-modified siloxanes and amino-functional siloxanes, particularly preferably ®Finish CT 34 E (silicone softener emulsions from Wacker) are also preferably suitable.

Other suitable hydrophobicizing agents are soil release polymers, e.g. polymers of phthalic acid and/or of terephthalic acid or derivatives thereof, in particular oligomeric terephthalate esters, polymers of ethylene terephthalates and polyethylene glycol terephthalates and also anionic and/or nonionic derivatives thereof.

Further suitable hydrophobicizing agents are cationic surfactants consisting of quaternary mono- ($C_8$–$C_{16}$)-N-Alkyl or -alkenyl ammonium salts whose N positions are occupied by methyl, hydroxymethyl or hydroxypropyl groups. Particular preference is given to distearyidimethylammonium chloride, ditallowdimethylammonium chloride, diethanolamine diesterquat, triethanolamine diesterquat and alkylhydroxyethyidimethylammonium chloride.

Other suitable hydrophobicizing agents are fluorine compounds, e.g. those from 3M.

The laundry detergents and cleaners preferably comprise 0.01 to 10% by weight, particularly preferably 0.1 to 5% by weight, of silicate-containing particles.

Preference is also given to concentrates which comprise up to 80% by weight of silicate-containing particles.

In the laundry detergents and cleaners, the weight ratio of water to silicate-containing particles is between 10 000:1 and 1:4.

The weight ratio of silicate-containing particles to hydrophobicizing agents is preferably between 100:1 and 1:100.

Preference is given to laundry detergents and cleaners which comprise to 10% by weight of silicate-containing particles, to 10% by weight of hydrophobicizing agent and up to 99.5% by weight of other laundry detergent/cleaner ingredients.

Also preferred are laundry detergents and cleaners which comprise to 10% by weight of silicate-containing particles, 0.5 to 60% by weight of interface-active substances and up to 99.5% by weight of other laundry detergent/cleaner ingredients.

Also preferred are laundry detergents and cleaners which comprise to 10% by weight of silicate-containing particles, to 10% by weight of hydrophobicizing agent, 0.5 to 60% by weight of interface-active substances and up to 99.5% by weight of other laundry detergent/cleaner ingredients.

The interface-active substances may be anionic, cationic, nonionic and/or zwitterionic surfactants.

Particularly preferred nonionic surfactants are alkyl alkoxylates, gluconamides and alkyl polyglycosides.

Of the alkyl alkoxylates, preference is given to using ethoxylated alcohols, preferably primary alcohols having, preferably, 8 to 22 carbon atoms and, preferably, 1 to 80 EO units per mole of alcohol, where the alcohol radical is linear or, preferably, methyl-branched in the 2-position, or contains linear and methyl-branched radicals in a mixture, as is usually the case in oxo alcohol radicals. Preferred ethoxylated alcohols include, for example, $C_{11}$-alcohols having 3, 5, 7, 8 and 11 EO units, ($C_{12}$–$C_{15}$)-alcohols having 3, 6, 7, 8, 10 or 13 EO units, ($C_{14}$–$C_{15}$)-alcohols having 4, 7 or 8 EO units, ($C_{16}$–$C_{18}$)-alcohols having 8, 11, 15, 20, 25, 50 or 80 EO units and mixtures thereof. The degrees of ethoxylation given are statistical average values which may be an integer or a fractional number for a specific product. In addition to these, it is also possible to use fatty alcohol-EO/PO adducts, such as, for example, the ®Genapol grades 3970, 2909 and 2822 from Clariant GmbH.

Further suitable surfactants are polyhydroxy fatty acid amides of the formula $R_2$—CO—N($R_3$)—Z, in which $R_2$CO is an aliphatic acyl radical having 6 to 22 carbon atoms, $R_3$ is hydrogen, an alkyl or hydroxyalkyl radical having 1 to 4 carbon atoms and Z is a linear or branched polyhydroxyalkyl radical having 3 to 10 carbon atoms and 3 to 10 hydroxyl groups. Preferably, alkyl glycosides of the formula $RO(G)_x$ can be used, in which R is a primary straight-chain or methyl-branched, in particular methyl-branched in the 2-position, aliphatic radical having 8 to 22, preferably 12 to 18, carbon atoms, and G is a glycose unit having 5 or 6 carbon atoms, preferably glucose. The degree of oligomerization x, which indicates the distribution of monoglycosides and oligoglycosides, is any desired number between 1 and 10; preferably 1.2 to 1.4.

Preference is also given to alkoxylated, preferably ethoxylated or ethoxylated and propoxylated, fatty acid alkyl esters, preferably having 1 to 4 carbon atoms in the alkyl chain, in particular fatty acid methyl esters as are described, for example, in Japanese patent application JP 58/217598, or preferably those prepared in accordance with the process described in international patent application WO A 90/13533.

Suitable anionic surfactants of the sulfonate type are preferably the known ($C_9$–$C_{13}$)-alkylbenzenesulfonates, alpha-olefinsulfonates and alkanesulfonates. Also suitable are esters of sulfo fatty acids or the disalts of alpha-sulfo fatty acids. Further suitable anionic surfactants are sulfated fatty acid glycerol esters, which are mono-, di- and triesters and mixtures thereof, as are obtained during the preparation by esterification by 1 mol of monoglycerol with 1 to 3 mol of fatty acid or in the transesterification of triglycerides with 0.3 to 2 mol of glycerol. Suitable alkyl sulfates are, in particular, the sulfuric monoesters of ($C_{12}$–$C_{18}$)-fatty alcohols, such as lauryl alcohol, myristyl alcohol, cetyl alcohol or stearyl alcohol, and the fatty alcohol mixtures obtained from coconut oil, palm oil and palm kernel oil which may additionally comprise fractions of unsaturated alcohols, e.g. oleyl alcohol.

Suitable further anionic surfactants are, in particular, soaps. Saturated fatty soaps, such as the salts of lauric acid, myristic acid, palmitic acid, stearic acid, hydrogenated erucic acid and behenic acid, and, in particular, soap mixtures derived from natural fatty acids, e.g. coconut, palm kernel or tallow fatty acids, are suitable. The anionic surfactants can be in the form of their sodium, potassium or ammonium salts, and in the form of soluble salts of organic bases, such as mono-, di- or triethanolamine. The anionic surfactants are preferably in the form of their sodium or potassium salts, in particular in the form of the sodium salts.

Further laundry detergent/cleaner ingredients are builders, cobuilders, alkali suppliers, antifoams, dispersants, pH regulators, complexing agents, bleaches, bleach activators and bleach catalysts and/or enzymes.

The builders are preferably crystalline alumino silicates, alkali metal carbonates, alkali metal orthophosphates, alkali metal pyrophosphates and alkali metal polyphosphates, crystalline phyllosilicates, crystalline alkali metal silicates without a layer structure and/or X-ray amorphous alkali metal silicates.

The cobuilders are preferably monomeric, oligomeric, polymeric or copolymeric carboxylic acids.

The bleach systems are preferably active chlorine carriers and/or organic or inorganic active oxygen carriers, bleach activators (e.g. TAED), bleach catalysts, enzymes for removing discolorations, perborates and/or percarbonates.

The pH regulators are preferably sodium carbonate, citric acid, sodium citrate and/or bicarbonate.

Finally, the laundry detergents and cleaners may optionally also comprise enzymes, such as, for example, proteases, amylases, lipases and cellulases.

The laundry detergents and cleaners can be used for the treatment of fiber and textile surfaces, but also for the treatment of hard surfaces made from very different materials, e.g. metals, glass, ceramics, plastics etc.

The laundry detergents are preferably heavy-duty detergents, compact heavy-duty detergents, compact color detergents, heavy-duty detergents of low bulk density, special detergents, such as, for example, laundry after-treatment compositions, laundry softeners, stain-removal salts, bleach boosters, net curtain detergents, wool detergents, modular detergents and commercial detergents.

The cleaners are generally cleaners for hard surfaces, such as, for example, facade, glass, ceramic, metal, window, floor and carpet cleaners.

The cleaners are preferably hand dishwashing detergents, machine dishwashing detergents, machine dishwashing cleaners and rinse aids.

Further preferred cleaners are automobile and paint cleaners for manual use and for automatic use in car washes.

The examples below serve to illustrate the invention without, however, limiting it. The compositions of the formulations according to the invention are given here in percent by weight.

EXAMPLES

Carrying Out the Gardner Test

The Gardner test is a cleaning test for hard surfaces, primarily floors etc. In the test, sample strips (maximum 45 cm long and 5–6 cm wide) are treated with the solution under investigation, dried and then soiled. To investigate the cleaning process, 10 g of the cleaning solution are placed onto the strips and one section of a dishcloth is attached to a holder. The cloth is moved backwards and forwards on the prepared sample strips by means of tension cables, driven by a cam. The number of wiping movements is registered by a counting device. The parameters evaluated are the number of wiping movements to absolute cleanliness, or after a maximum of 50 wiping movements, the grading of the cleaning results on a scale from 1 (clean) to 5.

The evaluation 50/3 means here that, after the maximum number of 50 wiping operations, the sample received grade 3 on the scale from 1 to 5.

The evaluation 5/1 means here that after just 5 wiping operations, the sample received grade 1 (clean) on the scale from 1 to 5.

The surfaces used were ceramic wall tiles and PVC floor tiles. The soilings used were Edding permanent pen, marking crayon and lead pencil (graphite).

Carrying Out the Machine Dishwashing Tests

In accordance with IEC standard 436 and IKW method, tests were carried out in 4 domestic dishwashing machines (2 Miele G 688 SC and 2 Bosch 6902) at a wash temperature of 55° C. and a dosage of 20 g.

The Soilings Were a) Oat flakes on porcelain soup plates and metal soup spoons, dried on at 80° C. for 2 hours. After the cleaning operation, the ware was dyed with iodine/potassium iodide solution and rated visually by reference to a photo catalog and a scale from 0 (dirty) to 10 (clean). The soup spoons are rated visually by reference to a scale from 0 to 10.
b) Egg on dessert plates, dried on at 80° C. for 2 hours. After the cleaning operation, the ware was rated visually by reference to a scale from 0 to 10.
c) Minced meat on dinner plates, dried on at 80° C. for 2 hours. After the cleaning operation, the ware was rated visually by reference to a scale from 0 to 10.
d) Minced meat on dinner plates, dried on at 120° C. for 2 hours. After the cleaning operation, the ware was rated visually by reference to a scale from 0 to 10.
e) Spinach on dessert plates, dried on at 80° C. for 2 hours. After the cleaning operation, the ware was rated visually by reference to a scale from 0 to 10.
f) Tea on porcelain cups, dried on at 80° C. for 2 hours. After the cleaning operation, the ware was rated visually by reference to a photo catalog and a scale from 0 to 10.
g) Milk, on the inside of a glass beaker, dried on in a microwave oven at 80° C. for 2 hours. After the cleaning operation, the ware was rated visually by reference to a photo catalog and a scale from 0 to 10.

The measured values were averaged arithmetically and spread on a scale from 0 to 100%.

Example 1 (Comparison)

An all-purpose cleaner was prepared by mixing Genapol UD 080 and Hostapur SAS 60 together. Water was then mixed in, and finally cumene sulfonate. The cleaning action was investigated using the Gardner test. The composition and the results are listed in table 1.

Example 2

An all-purpose cleaner was prepared as in example 1. In addition, Klebosol 30 V 25 was added with the water. As a result, an improvement in the cleaning action can be achieved in the Gardner test compared with example 1. The composition and the results are listed in table 1.

Example 3

An all-purpose cleaner was prepared as in example 1. In addition, Hectorite SKS-21 was added with the water. As a result, an improvement in the cleaning action can be achieved in the Gardner test compared with example 1. The composition and the results are listed in table 1.

Example 4

An all-purpose cleaner was prepared as in example 1. In addition, Klebosol 30 V 25 was added with the water, and TexCare SRC-1 dispersion was added with the cumin sulfonate. As a result, an improvement in the cleaning effect can be achieved in the Gardner test compared with examples 1 to 3. The composition and the results are listed in table 1.

Example 5 (Comparison)

A tile/bath cleaner was prepared by mixing isopropanol and water together. Then, Genapol UD 080, Hordaphos CC MS and Hostapur SAS 60 were mixed in with vigorous stirring and, finally, citric acid monohydrate. Using the Gardner test, the cleaning action was investigated. The composition and the results are listed in table 1.

Example 6

A tile/bath cleaner was prepared as in example 5. In addition, Klebosol 20 H 12 was added with the water. As a result, an improvement in the cleaning effect can be achieved in the Gardner test compared with example 5. The composition and the results are listed in table 1.

Example 7

A tile/bath cleaner was prepared as in example 5. In addition, Klebosol 20 H 12 was added with the water, and Finish CT 34 E was added with the citric acid. As a result, an improvement in the cleaning action can be achieved in the Gardner test compared with examples 5 and 6. The composition and the results are listed in table 1.

Example 8

A hand dishwashing detergent was prepared by mixing Hostapur SAS 60 with water and Klebosol 30 R 12. Then, Genagen CAB 818, Genapol UD 080 and Genapol ZRO liquid were mixed in with slow stirring. The composition is listed in table 2.

Example 9

A window cleaner was prepared by mixing Genapol LRO liquid with water and Klebosol 30 N 12. Then, ammonium hydroxide and isopropanol were mixed in with stirring. The composition is listed in table 2.

Example 10

A window cleaner was prepared by mixing Genapol LRO liquid with water and Klebosol 30 N 12. Then, ammonium hydroxide, isopropanol and Finish CT 34 E were mixed in with stirring. The composition is listed in table 2.

Example 11

An all-purpose cleaner was prepared by mixing Genapol UD 080 with Hostapur SAS 60. Then, water, Klebosol 30 R 12 and propylene glycol n-butyl ether were mixed in with stirring. The composition is listed in table 2.

Example 12

A tile/bath cleaner was prepared by mixing isopropanol with water. Then, Genapol UD 080, Hordaphos CC MS and Hostapur SAS 60 and, finally, were mixed in with stirring. The composition is listed in table 2.

Example 13

A cleaner for automatic car washes was prepared by successively dissolving Genapol UD 110 and Genapol UD 50 in water. Then, Klebosol 30 R 12 was mixed in. The composition is listed in table 2.

Example 14

A drying agent for automatic car washes was prepared by successively mixing butyl diglycol, acetic acid, conc., Genamin LAP 100 D and Praepagen 4317. Water and Klebosol 30 H 25 was then mixed in. The composition is listed in table 2.

Example 15

A hot wax for automatic car washes was prepared by successively mixing balsam turpentine oil, spindle oil, butyl diglycol, Genapol X 080 and Hoechst wax KST. Then, Praepagen WKT, water and Klebosol 30 H 25 were mixed in. The composition is listed in table 2.

Example 16

A machine dishwashing rinse aid was prepared by successively dissolving citric acid, cumin sulfonate, Genapol 2908 and Klebosol 30 H 25 in water. Dishes were washed using a standard commercial tablet dishwashing detergent in accordance with the general procedure "Carrying out the machine dishwashing tests". The rinse aid used was the formulation above. This procedure of cleaning and clear-rinsing was repeated, and the dishes were compared afterwards. The composition and the results are listed in table 3.

Example 17

A machine dishwashing rinse aid is prepared as in example 16. Klebosol 30 H 25 is additionally mixed in. Dishes were washed twice using a standard commercial tablet dishwashing detergent in accordance with the general procedure "Carrying out the machine dishwashing tests", and treated with the rinse aid. The use of silica sol produces clear advantages for the cleaning action. The composition and the results are listed in table 3.

Example 18

A pulverulent machine dishwashing detergent is prepared in a Lödige plowshare mixer by introducing the solid components, apart from enzymes, bleaches and perfume, and mixing them thoroughly. The alkyl ethoxylate and the Klebosol 30 V 50 are then sprayed on. Finally, enzymes, perfume and bleaching system are mixed in. The composition is listed in table 4.

Example 19

A liquid laundry detergent is prepared by mixing, with vigorous stirring, alkylbenzenesulfonate, citric acid, Genapol 3070, soap, water, silicone oil, phosphonate, polyglycol ether and Klebosol 30 V 50. The composition is listed in table 4.

Example 20

A pulverulent detergent is prepared by mixing antifoam, phyllosilicate, sodium carbonate, Sokalan CP5 and zeolite A in a Lödige plowshare mixer, and spraying on Genapol 3070. The remaining components were briefly mixed in. The composition is listed in table 4.

Example 21

A fabric softener is prepared by dissolving firstly Lapnite RD and then Praepagen WK in water at 50 to 60° C. with stirring. The composition is listed in table 4.

Example 22

A fabric softener is prepared by dissolving molten triethanolamine diesterquat (85%) in preheated water at 50° C., then stirring in Genapol UD 088, and cooling the solution. Finally, TexCare SRC-1 dispersion and Klebosol 30 V 50 is stirred in.

TABLE 1

| Example<br>Components [%] | 1<br>Comp. | 2 | 3 | 4 | 5<br>Comp. | 6 | 7 |
|---|---|---|---|---|---|---|---|
| Citric acid monohydrate | | | | | 3 | 3 | 3 |
| Cumin sulfonate | 2 | 2 | 2 | 2 | | | |
| Genapol UD 080 | 9 | 9 | 9 | 9 | 0.5 | 0.5 | 0.5 |
| Hordaphos CC MS | | | | | 1 | 1 | 1 |
| Hostapur SAS 60 | 8.3 | 8.3 | 8.3 | 8.3 | 3 | 3 | 3 |
| Isopropanol | | | | | 5 | 5 | 5 |
| Propylene glycol n-butyl ether | 3 | 3 | 3 | 3 | | | |
| Water | 77.7 | 76.7 | 76.7 | 75.7 | 87.5 | 86.5 | 86 |
| Klebosol 30 V 25 | | 1 | | 1 | | | |
| Klebosol 20 H 12 | | | | | | 1 | 1 |
| Hectorite SKS-21 | | | 1 | | | | |
| TexCare SRC-1 dispersion | | | | 1 | | | |
| Finish CT 34 E | | | | | | | 0.5 |
| Dosage | 10 g | 10 g | 10 g | 10 g | 10 g | 10 g | 10 g |
| Edding permanent/PVC tile | 50/5 | 50/3.5 | 50/3.5 | 50/3 | — | — | — |
| Marking crayon/PVC tile | 50/3 | 50/2.5 | 50/2.5 | 50/2 | — | — | — |
| Graphite/PVC tile | 5/1 | 2/1 | 3/1 | 2/1 | — | — | — |
| Edding permanent/ceramic wall tile | — | — | — | — | 50/4 | 50/2 | 50/1 |
| Marking crayon/ceramic wall tile | — | — | — | — | 50/2 | 50/1 | 50/1 |

TABLE 2

| Example<br>Components [%] | 8 | 9 | 10 | 11 | 12 | 13 | 14 | 15 |
|---|---|---|---|---|---|---|---|---|
| Ammonium hydroxide (w = 25%) | | 0.5 | 0.5 | | | | | |
| Balsam turpentine oil | | | | | | | | 2 |
| Butyl diglycol | | | | | | | 18 | 13 |
| Citric acid monohydrate | | | | | 3 | | | |
| Cumin sulphonate | | | | 2 | | | | |

TABLE 2-continued

| Example<br>Components [%] | 8 | 9 | 10 | 11 | 12 | 13 | 14 | 15 |
|---|---|---|---|---|---|---|---|---|
| Acetic acid, conc. | | | | | | | 0.8 | |
| Genagen CAB 818 | 10 | | | | | | | |
| Genamin LAP 100 D | | | | | | | 2 | |
| Genapol LRO liquid | | 0.5 | 0.5 | | | | | |
| Genapol O 020 | | | | | | | 5 | |
| Genapol DU 080 | 3 | | | 9 | 0.5 | | | |
| Genapol DU 110 | | | | | | 10 | | |
| Genapol DU 50 | | | | | | 3 | | |
| Genapol X 080 | | | | | | | | 2 |
| Genapol ZRO liquid | 22.9 | | | | | | | |
| Hoechst wax KST | | | | | | | | 4 |
| Hordaphos CC MS | | | | | 1 | | | |
| Hostapur SAS 60 | 42.7 | | | 8.3 | 3 | | | |
| Isopropanol | | 29 | 29 | | 3 | | | |
| Praepagen 4317 | | | | | | | 10 | |
| Praepagen WKT | | | | | | | | 11 |
| Propylene glycol n-butyl ether | | | | 3 | | | | |
| Spindle oil | | | | | | | | 6 |
| Water | 19.4 | 69 | 68 | 75.7 | 88.5 | 86 | 59.2 | 57 |
| Klebosol 30 R 12 | 2 | | | 2 | | 1 | | 5 |
| Klebosol 30 H 25 | | | | | 1 | | 5 | |
| Klebosol 30 N 12 | | 1 | 1 | | | | | |
| Finish CT 34 E | | | 1 | | | | | |
| Dosing | | | | | | 1:1000 | 1:1000 | 1:500 |

TABLE 3

| Components [%] | Example<br>16<br>Comp. | 17 |
|---|---|---|
| Citric acid | 3 | 3 |
| Cumin sulfonate, 40% | 8 | 8 |
| Genapol 2908 | 14 | 14 |
| Water | 75 | 74 |
| Klebosol 30 H 25 | 0 | 1 |
| Dosing g/cycle | 3 g | 3 g |
| Cleaning action % | 75 | 90 |

TABLE 4

| Example<br>Components [%] | 18 | 19 | 20 | 21 | 22 | 23 |
|---|---|---|---|---|---|---|
| Alkylbenzenesulfonate | | | 25 | 9 | | |
| Antifoam | | | | 1 | | |
| Citrate th | 35 | | | | | |
| Citric acid | | | 2 | | | |
| Cumin sulfonate, 40% | | | | | | |
| Genapol 2822 | 1.5 | 1.5 | | | | |
| Genapol 2908 | | | | | | |
| Genapol 3070 | | | 9 | 8 | | |
| Genapol UD 088 | | | | | | 0.5 |
| Makrophos 1018 | | 47 | | | | |
| Perfume | 0.3 | 0.3 | | | | |
| Peractive AC White | 5 | 2 | | | | |
| Peractive AN | | | | 5 | | |
| Perborate mh | — | 10 | | 18 | | |
| Percarbonate | 10 | — | | | | |
| Praepagen WK | | | | | 6.7 | |
| Savinase 6.0 TW | 1.5 | 1.5 | | 1.5 | | |
| Phyllosilicate | 5 | 5.2 | | 15 | | |
| Soap | | | 5 | 1.5 | | |
| Sodium carbonate | 31.7 | 25.5 | | 12.5 | | |
| Sokalan CP45 | 7.5 | 3.5 | | | | |
| Sokalan CP5 | | | | 6 | | |
| Termamyl 120T | 1.5 | 1.5 | | | | |
| Termamyl 60T | | | | 1.5 | | |
| TexCare SRC-1 dispersion | | | | | | 4 |

TABLE 4-continued

| Example<br>Components [%] | 18 | 19 | 20 | 21 | 22 | 23 |
|---|---|---|---|---|---|---|
| Triethanolamine diesterquat (85%) | | | | | | 5.5 |
| Water | | | 40 | | 93.2 | 89 |
| Zeolite A | | | | 20 | | |
| Wacker silicone oil | | | 1 | | | |
| Phosphonate | | | 1 | | | |
| Polyglycol ether | | | 15 | | | |
| Klebosol 30 V 50 | 1 | 2 | 2 | 1 | | 1 |
| Laponite RD | | | | | 0.1 | |
| Dosing g/cycle | 20 g | 20 g | 130 g | 20 g | 5–7 g | 5–7 g |

| List of substances used: | |
|---|---|
| Alkylbenzenesulfonate | Marlon ARL, Hüls |
| Ammonium hydroxide (w = 25%) | Riedel de Haen |
| Antifoam | Wacker |
| Balsam turpentine oil | — |
| Butyl diglycol | Merck |
| Citric acid | Jungbunzlauer |
| Citric acid monohydrate | Jungbunzlauer |
| Cumin sulfonate | Condea |
| Acetic acid, conc. | Riedel de Haen |
| Finish CT 34 E | Wacker |
| Genagen CAB 818 | Clariant |
| Genamin LAP 100 D | Clariant |
| Genapol 2822 | Clariant |
| Genapol 2908 | Clariant |
| Genapol 3070 | Clariant |
| Genapol LRO liquid | Clariant |
| Genapol O 020 | Clariant |
| Genapol UD 080 | Clariant |
| Genapol UD 088 | Clariant |
| Genapol UD 110 | Clariant |
| Genapol UD 50 | Clariant |
| Genapol X 080 | Clariant |
| Genapol ZRO liquid | Clariant |
| Hectorite SKS-21 | Clariant |
| Hoechst wax KST | Clariant |

-continued

| List of substances used: | |
|---|---|
| Hordaphos CC MS | Clariant |
| Hostapur SAS 60 | Clariant |
| Isopropanol | Riedel de Haen |
| Klebosol 20 H 12 | Clariant |
| Klebosol 30 H 25 | Clariant |
| Klebosol 30 N 12 | Clariant |
| Klebosol 30 R 12 | Clariant |
| Klebosol 30 V 25 | Clariant |
| Klebosol 30 V 50 | Clariant |
| Laponite RD | Laporte |
| Macrophos 1018 | BK Giulini |
| Perfume | Lemon perfume 78122D, Orissa |
| Peractive AC White | Clariant |
| Peractive AN | Clariant |
| Perborate mh | Degussa |
| Percarbonate | Oxyper C, Solvay Interox |
| Phosphonate | Dequest 2041, Monsanto |
| Polyglycol ether | Clariant |
| Praepagen 4317 | Clariant |
| Praepagen WK | Clariant |
| Praepagen WKT | Clariant |
| Propylene glycol n-butyl ether | Merck |
| Savinase 6.0 TW | Solvay Enzymes |
| Phyllosilicate | Clariant |
| Soap | Liga base soap HM11E |
| Sodium carbonate | Heavy soda, Matthes&Weber |
| Sokalan CP45 | BASF |
| Sokalan CP5 | BASF |
| Spindle oil | — |
| Termamyl 120T | Solvay enzymes |
| Termamyl 60T | Solvay enzymes |
| TexCare SRC-1 dispersion | Clariant |
| Triethanolamine diesterquat | Clariant |
| Wacker silicone oil | Wacker |
| Water | — |
| Zeolite A | Wessalith P, Degussa |

What is claimed is:

1. A laundry detergent or cleaner which comprises microdisperse, hydrophilic silicate-containing particles having an electrically charged surface and a particle size of from 2 to 50 nm, said particles are selected from the group consisting of colloidal silica gels, colloidal silica sols, saponites and mixtures thereof said laundry detergent or cleaner comprising at least one hydrophobicizing agent selected from the group consisting of fluorosilicone oils, soil release polymers, cationic surfactants, organic fluorine compounds, and mixtures thereof.

2. The laundry detergent or cleaner as claimed in claim 1, which further comprises 0.01 to 10% by weight of said silicate-containing particles, 0.01 to 10% by weight hydrophobicizing agents and 80 to 99.8% by weight of other laundry detergent, cleaner ingredients.

3. The laundry detergent or cleaner as claimed in claim 1, which further comprises 0.01 to 10% by weight of said silicate-containing particles, 0.01 to 10% by weight of hydrophobicizing agent, 0.5 to 60% by weight of interface-active substances and 20 to 99.48% by weight of other laundry detergent ingredients.

4. The laundry detergent or cleaner as claimed in claim 1, which further omprises 0.01 to 10% by weight of said silicate-containing particles, 0.5 to 60% by weight of interface-active substances, and 30 to 99.49% by weight of other laundry detergent/cleaner ingredients.

5. The laundry detergent or cleaner as claimed in claim 1, which further comprises other laundry detergent/cleaner ingredients selected from the group consisting of builders, cobuilders, alkali suppliers, antifoams, dispersants, complexing agents, bleaches, bleach activators and bleach catalysts, enzymes, and mixtures thereof.

6. The laundry detergent or cleaner as claimed in claim 1, in a form selected from the group consisting of a heavy-duty detergent, compact heavy-duty detergent, compact color detergent, heavy-duty detergent of low bulk density, and a special detergent, wherein said special detergent is selected from the group consisting of a laundry after-treatment compositon, laundry softener, stain-removal salts, bleach booster, net curtain detergent, wool detergent, modular detergent and industrial detergent.

7. The laundry detergent or cleaner as claimed in claim 1, in the form of a cleaner for hard surfaces, wherein said hard surfaces are selected from the group consisting of facade, glass, metal, window, floor, and carpet cleaner.

8. The laundry detergent or cleaner as claimed in claim 7, in the form selected from the group consisting of a hand dishwashing detergent, machine dishwashing detergent, machine dishwashing cleaner, and rinse aid.

9. A process for releasing soil and reducing the tendency for resoiling in laundry detergent and cleaners comprising adding to said laundry detergents and cleaners microdisperse, hydrophilic silicate-containing particles having a particle size of from 9 to 50 nm, an electrically charged surface, and said particles being selected from the group consisting of colloidal silica gels, colloidal silica sols, hectorites, saporites and mixtures thereof, said laundry detergents and cleaners comprising at least one hydrophobicizing agent selected from the group consisting of flucrosilicone oils, soil release polymers, cattonic surfactants, organic fluorine compounds, and mixtures thereof.

* * * * *